United States Patent [19]

Berry et al.

[11] 4,448,471

[45] May 15, 1984

[54] POLARIZED LOCKING LATCH COVER FOR AN ELECTRICAL CONNECTOR

[75] Inventors: Donald A. Berry, Elizabethtown; David J. Fabian, Harrisburg, both of Pa.

[73] Assignee: AMP Incorporated, Harrisburg, Pa.

[21] Appl. No.: 379,836

[22] Filed: May 20, 1982

[51] Int. Cl.[3] ..... H01R 13/58

[52] U.S. Cl. ..... 339/91 R; 339/103 M; 339/104; 339/186 M

[58] Field of Search ..... 339/91 R, 97 R, 97 P, 339/98, 99 R, 103 M, 104, 107, 184 M, 186 M, 206 R

[56] References Cited

U.S. PATENT DOCUMENTS

| | | | |
|---|---|---|---|
| 3,569,900 | 3/1971 | Uberbacker | 339/107 |
| 3,794,960 | 2/1974 | Sugar | 339/107 |
| 4,037,906 | 7/1977 | Jayne | 339/107 |
| 4,243,288 | 1/1981 | Lucius et al. | 339/99 R |
| 4,269,466 | 5/1981 | Huber | 339/107 |
| 4,299,433 | 11/1981 | Jayne | 339/91 R |
| 4,341,431 | 7/1982 | Woratyla | 339/103 M |
| 4,367,005 | 1/1983 | Douty et al. | 339/107 |
| 4,380,361 | 4/1983 | Asick et al. | 339/206 R |

*Primary Examiner*—John McQuade

*Attorney, Agent, or Firm*—Russell J. Egan

[57] ABSTRACT

A cover assembly formed by a pair of mating cover members interengage with the housing of an electrical connector and with each other to provide polarization/keying and latching for the connector as well as strain relief for the conductors leading from the connector. The covers together define conductor exiting which can be normal to or parallel to the mating face of the connector or any combination of exiting. The strain relief is provided by a known cable or bundle tie encircling the conductors and passing through belt loop extensions on one of the covers.

1 Claim, 4 Drawing Figures

POLARIZED LOCKING LATCH COVER FOR AN ELECTRICAL CONNECTOR

The present invention relates to an improved cover for a mass terminatable electrical connector, which cover provides latching, polarization, cable exit directing, and strain relief.

The present invention is related to the type of electrical connector shown in U.S. Pat. No. 4,243,288 and can serve as a substitute for the hermaphroditic covers shown in the patent. This type of electrical connector is particularly suitable for automated and/or mass termination techniques and for use in cooperation with a variety of covers providing specialized interconnection features. The present invention relates to a combination of features not heretofore known.

The present invention satisfies the need to provide a variation in the profile in the standard electrical connector in order to assure proper mating with a further connector or a particular piece of apparatus. The changes in profile reflect the requirement for polarization and/or keying of the connector as well as for providing latchability and the desired cable exiting, not only in direction but with strain relief. The present invention is able to accomplish these changes of modification in the profile without becoming unduly burdensome by requiring major alterations of the basic connector itself.

The present invention relates to a cover assembly to be used in connection with an electrical connector in order to selectively vary the profile of the connector to provide both polarization/keying, latching, and cable handling for the connector. The invention comprises a pair of mating housing members each having a first end adopted to engage in a portion of an associate electrical connector and an opposite end profiled to latchingly engage with the other of the cover members. At least one of the cover members is provided with polarization/keying means. At least one of the cover members is provided with latching means to secure the assembly to a mating device. The cover members together define therebetween at least one cable passage and means to secure the cable within the passage to provide strain relief therefore. A connector provided with the covers according to the present invention can be mated with a pin header having polarization and/or latching means as desired.

The present invention will be described by way of example with reference to the accompanying drawings in which.

Figure 1:
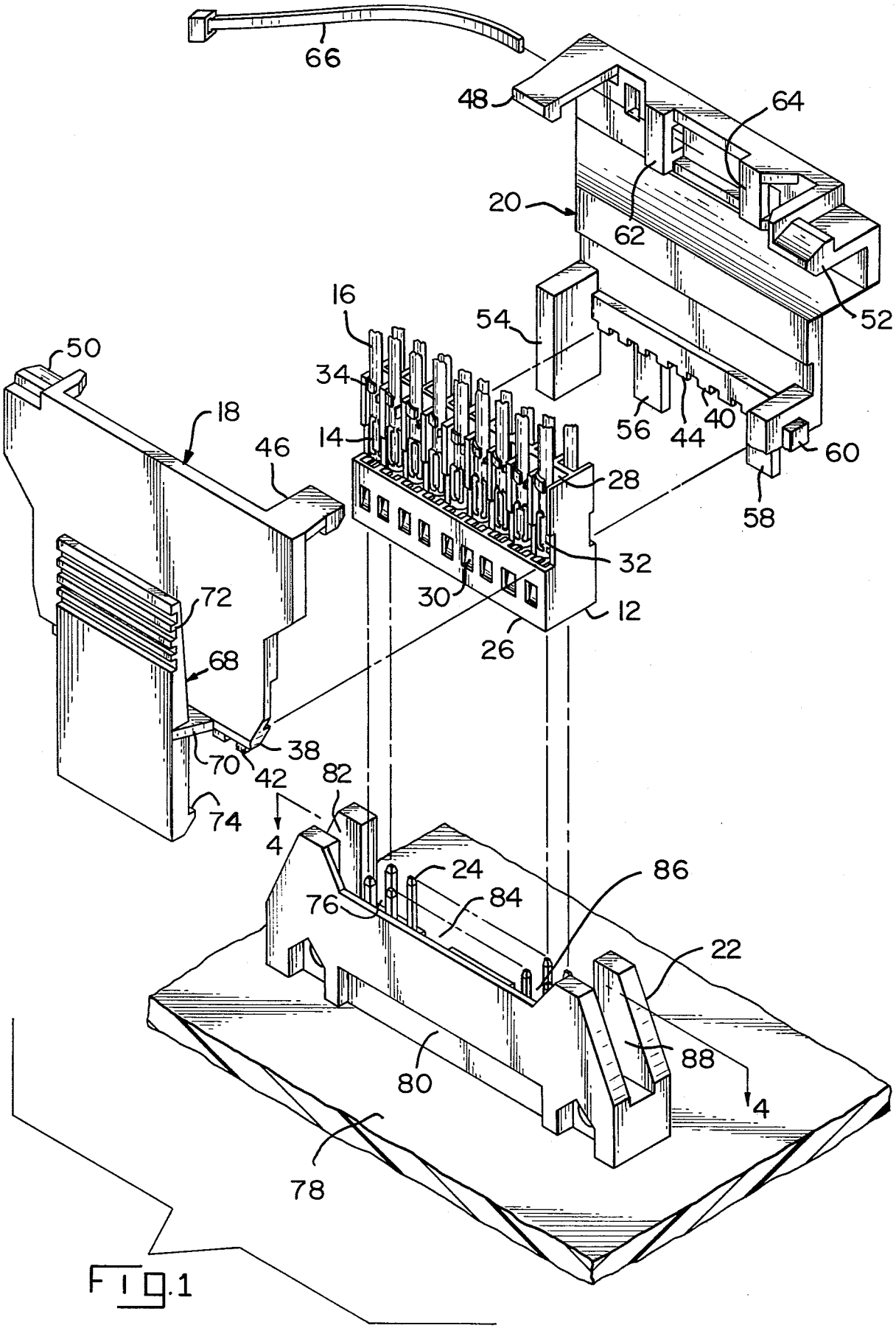
FIG. 1 is an exploded perspective view of the subject invention.

The subject electrical connector assembly 10 (FIG. 2) includes a connector housing 12 carrying a plurality of terminals 14, each terminating a respective wire 16, first and second cover members 18, 20, and a header 22 enclosing a like plurality of pin terminals 24. The connector housing 12 and terminals 14 are of the type described in U.S. Pat. No. 4,243,288, the disclosure of which is incorporated herein by reference. The connector housing 12 is an elongated member of rigid plastics material having a mating face 26 with a plurality of terminal passages 28 opening therein in a pair of aligned.

The sides of the connector housing 12 are open at the rear so that the passages 28 are fully enclosed at their forward ends and are channel shaped, opening outwardly, at their rearward ends. The connector housing 12 is also provided with a plurality of apertures 30 each aligned with a respective passage 28 and spaced rearwardly of the mating face 26. A plurality of terminals 14 are provided, each in a respective passage 28, with each terminal 14 having a mating profile (not shown) directed towards the mating face 26 and an insulation displacing rear portion 32 and a pair of crimp ears 34 lying in the open rear channel portion of each passage 28. A plurality of individual wires 16 are each terminated by insulation piercing into a respective rear portion 32 of a terminal 14 and secured therein by crimping of the ears 34.

Figure 2:
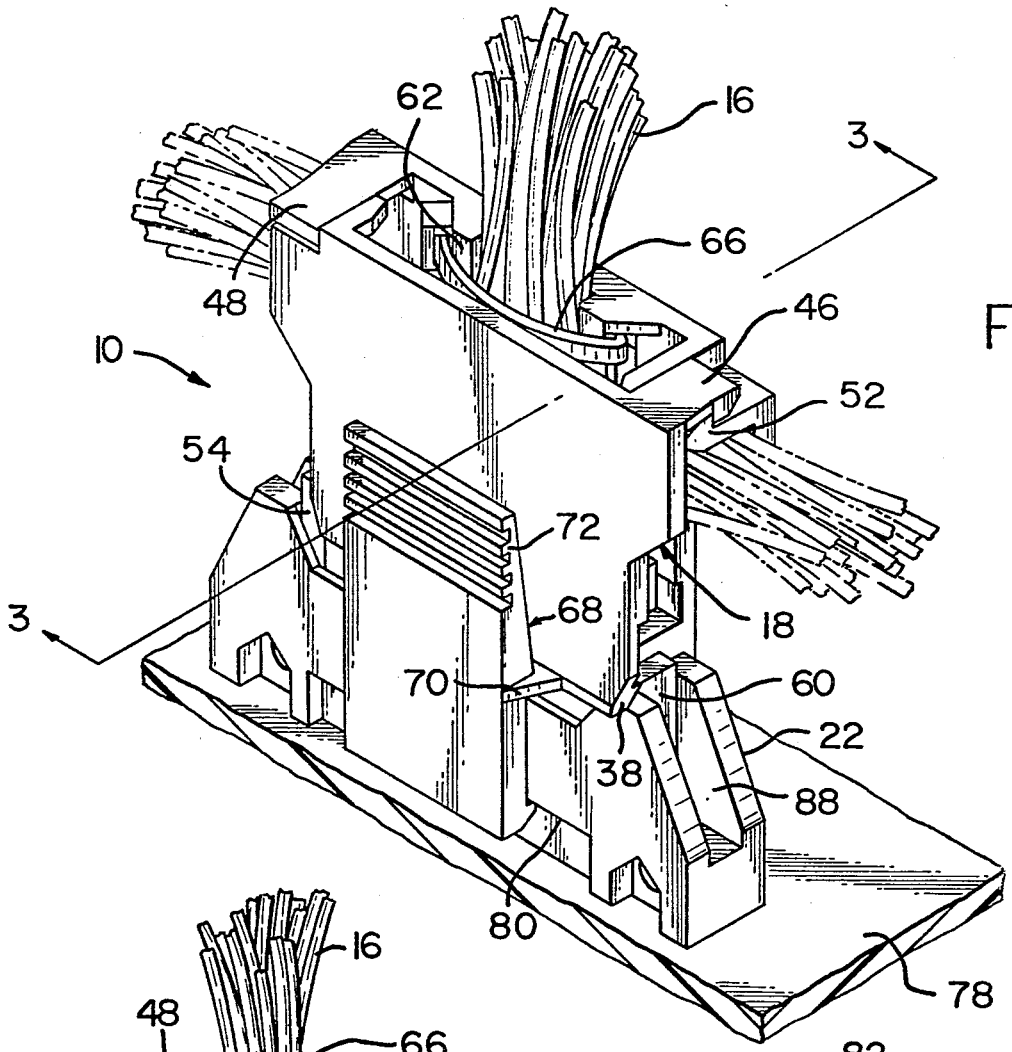
FIG. 2 is a perspective view of the subject invention in an assembled and mated condition.
Figure 3:
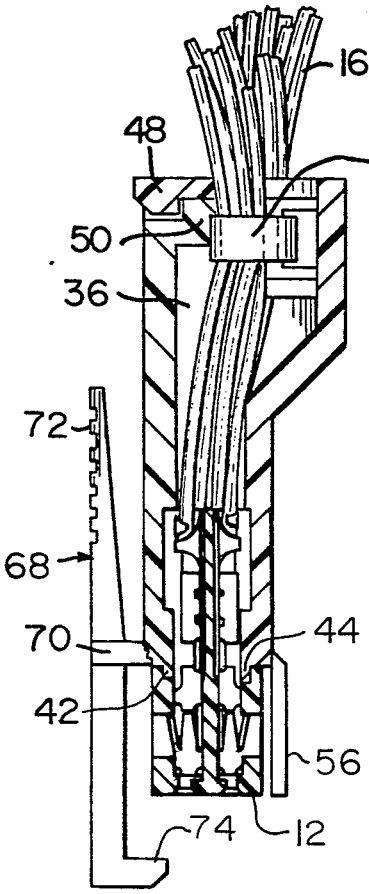
FIG. 3 is a section taken along line 3—3 of FIG. 2.
Figure 4:
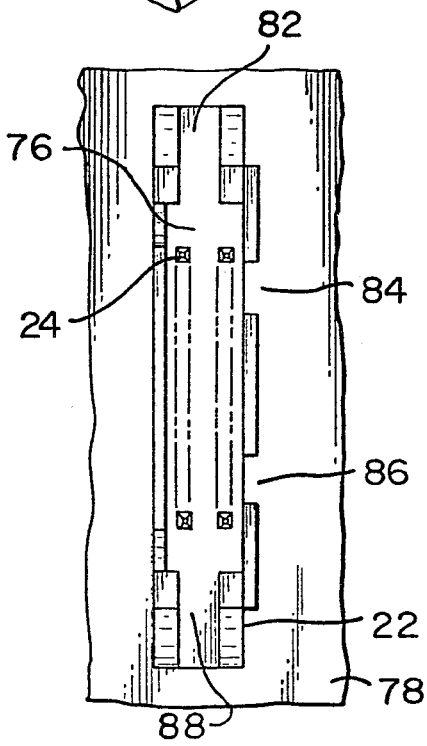
FIG. 4 is a section taken along line 4—4 of FIG. 1.

The covers 18, 20 together define a connector receiving cavity 36 with three cable exit ports in a single plane spaced 90° from each other, as shown in FIG. 2. Each cover member has a forwardly directed mating edge 38, 40 each with a plurality of spaced tines 42, 44, respectively, with each tine spaced to be received in a respective passage 28 of the connector housing 12. The covers 18, 20 are each provided with a latching leg 46, 48 and a latching lug 50, 52 positioned so that the leg 46, 48 of one cover engages the lug 50, 52 of the opposite cover. In this instance, the cover 20 is also provided with keying and polarizing blocks 54, 56, 58, 60. A portion of block 60 has been broken away in FIG. 1 for clarity. Blocks 54 and 60 depend from the plane defined by cover 20 and would enclose opposite ends of connector housing 12 modify the profile thereof for keying and/or polarization. The blocks 56, 58 are parallel to and spaced outwardly from the tines 44, as best seen in FIG. 3. Blocks 54, 56, 58, 60 are all of sufficient length to have their free ends coplanar with mating face 26 of connector housing 12. The cover 20 is further provided with at least one a pair of U-shaped members 62, 64 which are integral with the inner surface of the cover 20 and form a structure similar to belt loops for receiving a bundle tie 66 therein to secure the wires 16 to the cover 20. The bundle tie 66 is preferably of the type shown in U.S. Pat. No. 3,964,133, the disclosure of which is incorporated herein by reference, although many other similar ties could be used. The cover 20 is also profiled so that the wires can exit to either the left or the right of the connector (as shown in phantom in FIG. 2) rather than straight out as shown in FIGS. 2 and 3.

The cover 18 is provided with a latching member 68 which is pivotally attached at 70 intermediate its ends and has an outwardly directed profiled actuation surface 72 on one end and an inwardly directed shoulder 74 on the other end.

The header 22 is an elongated member of rigid plastic material having a plurality of pin terminals 24 mounted therein and a central connector receiving cavity 76. The terminals 24 are used to stake the header 22 to a circuit board 78. The header 22 is profiled to have a latching shoulder 80 and recesses 82, 84, 86, and 88 which respectively receive the keying and polarizing blocks 54, 56, 58, 60 of the cover member 20.

The covers of the present invention are assembled with the connector 12 by first determining how the wires 16 are to be led away from the connector. If they are to be fed straight out, as in FIGS. 2 and 3, the wires 16 would be appropriately gathered and secured in a bundled condition by the cable tie 66 passing around the wires and through the belt loops 62, 64 of the cover 20. The tines 44 of the cover 20 would be inserted into the appropriate passages 28 of the connector housing 12 and the slack taken out of the wires 16. The cover 18 would then be mated with the cover 20 by inserting the tines 42 into the respective passages 28 and rotating the cover 18 to bring the latching legs 46, 48 into engagement with the respective lugs 50, 52. The thus assembled connector 10 would then be applied to a pin header 22 in conventional fashion with shoulder 74 of the latching arm 68 making engagement with the shoulder 80 to secure the members together.

We claim:

1. In combination with an electrical connector having an elongated housing of rigid insulative material with a plurality of terminal passages extending from a rear portion through said housing to open on a front mating face, each passage being fully enclosed toward the mating face and having an outwardly directed, open channel shape toward the rear portion remote from said mating face, a plurality of terminals each mounted in a respective one of said passages with each terminal having a forwardly directed mating portion lying in said fully enclosed portion of said passage and an insulation displacing conductor engaging rear portion lying in and accessible from said rear channel shaped portion, a pair of mating cover members comprising:

a first cover member having a forward edge receivable against a first side of said housing with a plurality of tines extending from said forward edge and received in said fully enclosed portions of respective passages to hold said first cover member in assembly therewith and an opposite spaced rear edge having at least one latching leg extending normal to the plane of said first cover member and at least one latching shoulder;

a second cover member having a forward edge receivable against a second opposite side of said housing with a plurality of tines extending from said forward edge and received in said fully enclosed portions of respective passages to hold said second cover member in assembly therewith and an opposite spaced rear edge having at least one latching leg extending normal to the plane of said second cover member and at least one latching shoulder, each said leg of one cover member being positioned to engage a shoulder of the other cover member;

keying means extending in cantilever fashion forwardly of a respective forward edge of one of said cover members parallel to and spaced from said tines to overlie said housing, the free end of said keying means being coplanar with said mating face;

at least one end wall depending from an end of one of said cover members and extending normal to the plane of said cover member to substantially enclose an end portion of said housing forming a keying-/polarization profile therefore;

means on one of said cover members to latchingly engage a mating connector member;

at least one U-shaped member integral with an inner surface of one of said cover members forming a belt loop configuration, and tie means passing through each said U-shaped member and about conductors terminated by said connector to secure said conductors to said one of said cover members providing strain relief for said conductors.

* * * * *